US008356834B1

(12) United States Patent
Liao et al.

(10) Patent No.: US 8,356,834 B1
(45) Date of Patent: Jan. 22, 2013

(54) AIRBAG WITH BENT HEAD PORTION AND A REPEATED SEALING AND FILLING EFFECT

(76) Inventors: Yaw Shin Liao, New Taipei (TW); Kao Hsiung Liao, New Taipei (TW)

( * ) Notice: Subject to any disclaimer, the term of this patent is extended or adjusted under 35 U.S.C. 154(b) by 0 days.

(21) Appl. No.: 13/219,715

(22) Filed: Aug. 29, 2011

(51) Int. Cl.
*B60R 21/16* (2006.01)

(52) U.S. Cl. ..... 280/729; 280/738; 280/743.1

(58) Field of Classification Search ..... 280/729, 280/738, 743.1
See application file for complete search history.

(56) References Cited

U.S. PATENT DOCUMENTS

| | | | | |
|---|---|---|---|---|
| 7,922,190 | B2 * | 4/2011 | Sugimoto et al. | 280/729 |
| 8,186,710 | B2 * | 5/2012 | Cheal et al. | 280/730.2 |
| 8,196,955 | B2 * | 6/2012 | Mendez | 280/729 |
| 8,215,671 | B2 * | 7/2012 | Bergstrom et al. | 280/743.2 |
| 8,240,705 | B2 * | 8/2012 | Ishida | 280/729 |
| 2003/0222437 | A1 * | 12/2003 | Tanaka | 280/729 |
| 2006/0175813 | A1 * | 8/2006 | Heudorfer et al. | 280/730.2 |
| 2007/0052212 | A1 * | 3/2007 | Powals | 280/729 |
| 2008/0185823 | A1 * | 8/2008 | Kalliske et al. | 280/729 |
| 2010/0225095 | A1 * | 9/2010 | Smith et al. | 280/729 |
| 2011/0001307 | A1 * | 1/2011 | Mendez | 280/729 |
| 2011/0049846 | A1 * | 3/2011 | Hirth et al. | 280/729 |

* cited by examiner

*Primary Examiner* — Toan To

(57) ABSTRACT

An airbag with a bent head portion and a repeated sealing and filling effect comprises a bag body formed of buffer air columns, and heat-sealing nodes formed on the air column, such that the air column is bent when passing the node. A containing groove is formed in the bag body, and the bag body includes a bag mouth interconnected to the containing groove; a plurality of inflatable extended-section air columns arranged on a side of the external periphery of the bag mouth, and a non-inflatable protruding plate is arranged at an edge of the extended-section air column; an extended-section plate, disposed on the other side of the bag mouth, and a disposing entrance is formed between the extended-section plate and the protruding plate for a repeated use of the airbag. The airbag and its manufacturing method overcome the problem of the conventional packaging bag that cannot be used repeatedly.

11 Claims, 11 Drawing Sheets

AIRBAG WITH BENT HEAD PORTION AND A REPEATED SEALING AND FILLING EFFECT

BACKGROUND OF THE INVENTION

1. Field of the Invention

The present invention relates to a packaging bag technology, in particular to an airbag with a bent head portion and a repeated sealing and filling effect.

2. Description of the Prior Art

At present, transparent inflatable bags have been used extensively for packing fragile objects, such that when an external impact is exerted onto the objects, a buffering function is provided for preventing the objects from being broken or damaged.

In present existing techniques of sealing an air-column bag, there is no air column formed above a sealing line, so that the seal must be torn and the air column must be broken before the objects can be taken out. In other words, such conventional bag cannot be used repeatedly.

In another air-column bag with a square shape and having openings for a flexible access of the objects in the bag, but such conventional bag with openings fails to resist moisture and ultraviolet light.

Obviously, a buffering airbag with the repeated use function is required.

SUMMARY OF THE INVENTION

Therefore, it is a primary objective of the present invention to provide an airbag, comprising:

a bag body, formed by a plurality of buffer air columns, and having a plurality of heat-sealing nodes formed on the air column, and the air column being bent when passing through the node, and the bag body having a containing groove formed therein, and bag mouth formed on the bag body and interconnected to the containing groove;

a plurality of inflatable extended-section air columns, arranged on a side of the external periphery of the bag mouth, and having a non-inflatable protruding plate formed at an edge of the extended-section air column; and an extended-section plate, disposed on the other side of the external periphery of the bag mouth, and a disposing entrance being formed between the extended-section plate and the protruding plate for a repeated seal.

In the present invention, the air column and the extended-section air column are interconnected with each other, and the node is formed between the spacer column and the extended-section air column, and the air column is inflated, and the extended-section air column is bent towards a side of the extended-section plate when passing the node to form a flat buffer air column surface for covering the object to be packaged.

The containing groove contains the object to be packaged, and the air column is inflated, and the disposing entrance is maintained at an open state, and the extended-section plate and the extended-section air column are stacked to form a flat buffer structure at the top of the object to be packaged.

The containing groove contains the object to be packaged, and the air column is inflated, and the disposing entrance is maintained at an open state, and the extended-section plate is bent towards a side of the extended-section air column, and the extended-section air column is bent towards a side of the extended-section plate a side, and the extended-section plate is disposed on an internal side of the extended-section air column to form a stop plate to prevent the head portion of the object to be packaged from piercing and breaking the extended-section air column.

Wherein, an external film or a plate for forming the bag body and extended-section air column is made of an opaque plastic material to shadow an external light from projecting through the bag mouth into the containing groove.

The extended-section plate has a length equal to or unequal to the length of the extended-section air column. If the length of the extended-section plate is greater than the length of the extended-section air column, an extra portion forms a folding block to be placed together with the object to be packaged into the containing groove to form a natural cover for shadowing the light without sealing the disposing entrance.

Wherein, each of the adjacent extended-section air columns in a connecting area with the extended-section plate is hot sealed to reduce the extended-section air column in compliance with the bag mouth.

The node is in a square, circular-dot, elliptical or arch shape.

The extended-section air column is inflated into a shape, a length, and an area according to the length of the protruding plate and the condition of a bump-like head position of an object to be packaged.

The protruding plate and the extended-section plate are cut open at the position of the disposing entrance, and sealed again for a plurality of times.

The present invention has one or more of the following advantages or effects:

The airbag includes the plurality of inflatable extended-section air column together with the non-inflatable plastic extended-section plate extended upwardly and disposed at the upper end of the opening of the containing groove of the bag body, and a section (protruding plate) is reserved at an end of the extended section to form a new disposing entrance after the extended section is extended for the purpose of a repeated sealing. The airbag can be opened without damaging the original bag body, so that the airbag can be filled and sealed repeatedly after the airbag is opened.

In addition the node is formed between the inflatable extended-section air column and the opening of the containing groove, so that after the extended-section air column is inflated, the extended-section air column can be bent at the position of the containing groove to form a bendable structure, so as to produce a head portion of a flat buffer structure for a right-angle buffering effect and an effective protective function.

The airbag of the present invention can be sealed, and the plastic film can be made of an opaque plastic material for resisting right without adding an additional black bag. In addition, the head portion of the airbag will not form a sharp corner after the airbag is inflated, so that the drawback of requiring a large carton no longer exists.

DETAILED DESCRIPTION OF THE PREFERRED EMBODIMENTS

Figure 1:
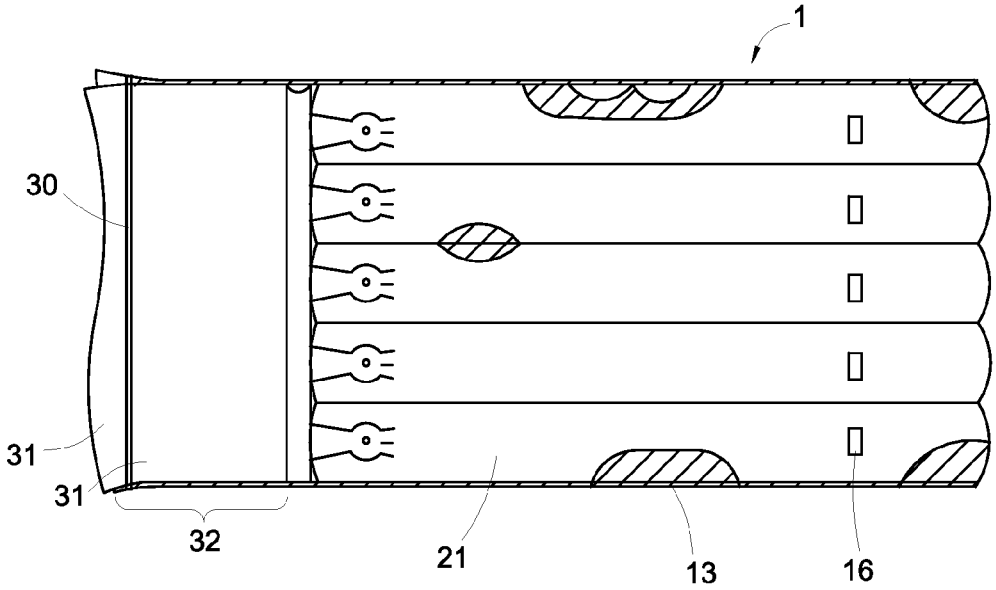
FIG. 1 is a planar view of an airbag in accordance with a first preferred embodiment of the present invention.

The present invention provides an airbag with a bent head portion and a repeated sealing and filling effect to achieve the effects of resisting moisture, dust, light, and electrostatic charge, providing a buffer and a protection, and allowing a repeated use of the airbag without damaging the original bag body after the airbag is opened. The invention is a multi-functional air column packaging bag that complies with the environmental protection requirements and achieves the effects of simplifying the manufacturing procedure, saving materials, and reducing wastes.

With reference to FIGS. 1 to 3A for the airbag with a bent head portion and a repeated sealing and filling effect in accordance with the first preferred embodiment of the present invention; the airbag comprises:

a bag body 1, formed by a plurality of buffer air columns, a plurality of heat-sealing nodes 16 formed on the air column, and the air column being bent when passing through the node 16, and the bag body 1 containing a containing groove 10 formed therein, and the bag body 1 having a bag mouth 101 interconnected to the containing groove 10;

a plurality of inflatable extended-section air columns 32, disposed on a side of the external periphery of the bag mouth 101, and a non-inflatable protruding plate 33 being formed at an edge of the extended-section air column 32; and an extended-section plate 31, disposed on the other side of the bag mouth 101, and a disposing entrance 102 being formed between the extended-section plate 31 and the protruding plate 33 for a repeated sealing.

Figure 4A:
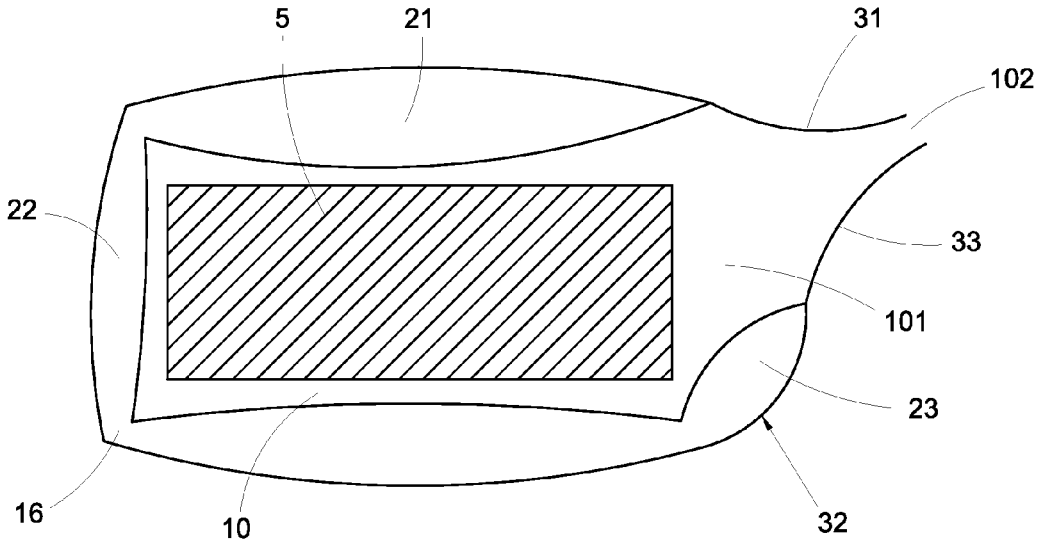
FIG. 4A is a schematic view of a first step for putting the airbag in accordance with the first preferred embodiment of the present invention into a carton.
Figure 4B:
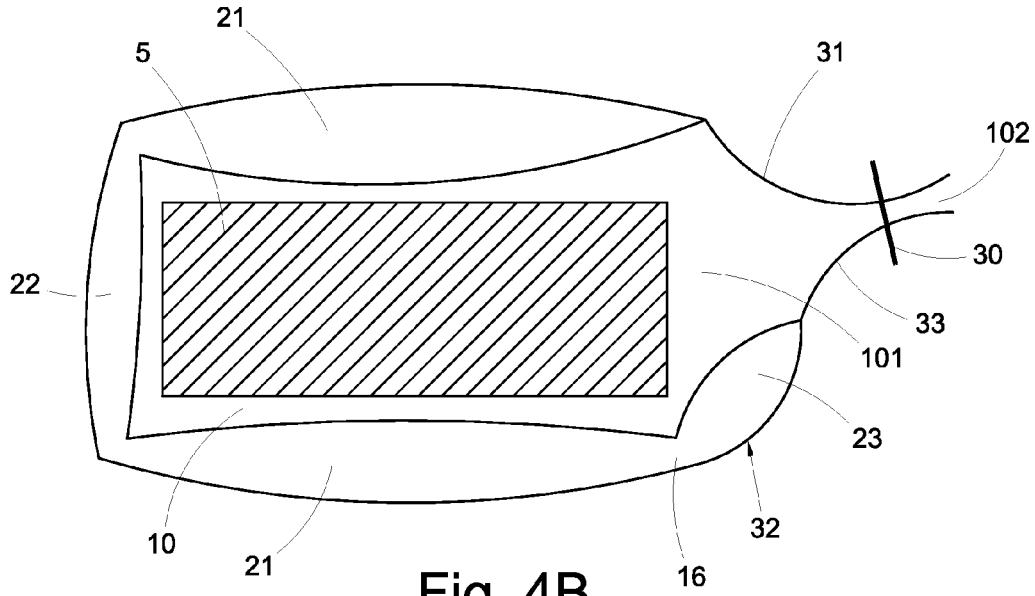
FIG. 4B is a schematic view of a second step for sealing the airbag in accordance with the first preferred embodiment of the present invention that is put into a carton.
Figure 4C:
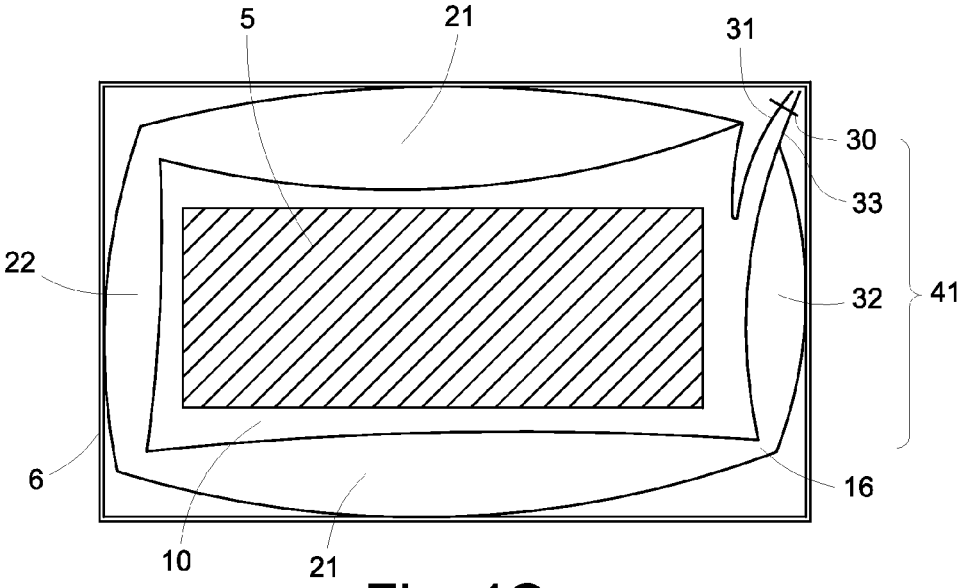
FIG. 4C is a schematic view of a third step for putting the airbag in accordance with the first preferred embodiment of the present invention into a carton.
Figure 5A:
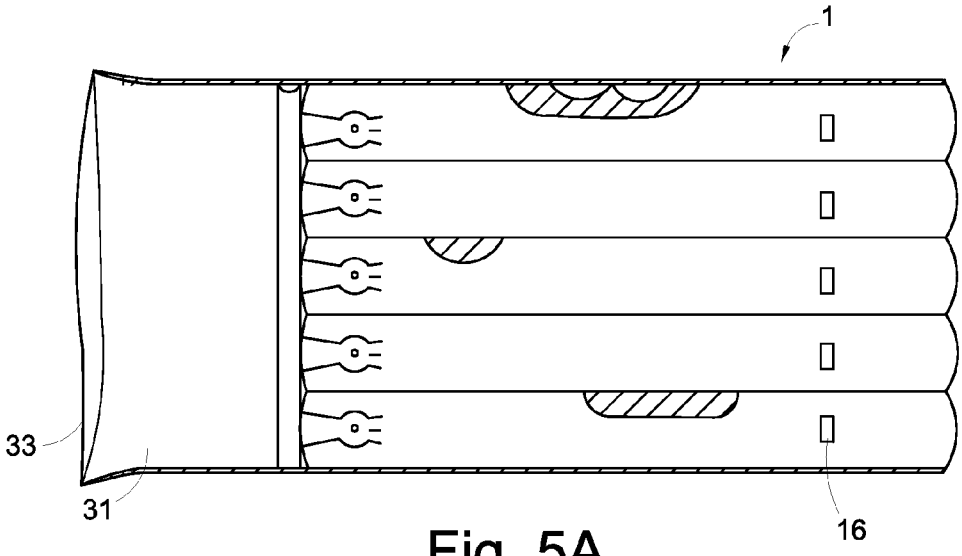
FIG. 5A is a front-side view of the airbag that requires no sealing in accordance with a second preferred embodiment of the present invention.
Figure 5B:
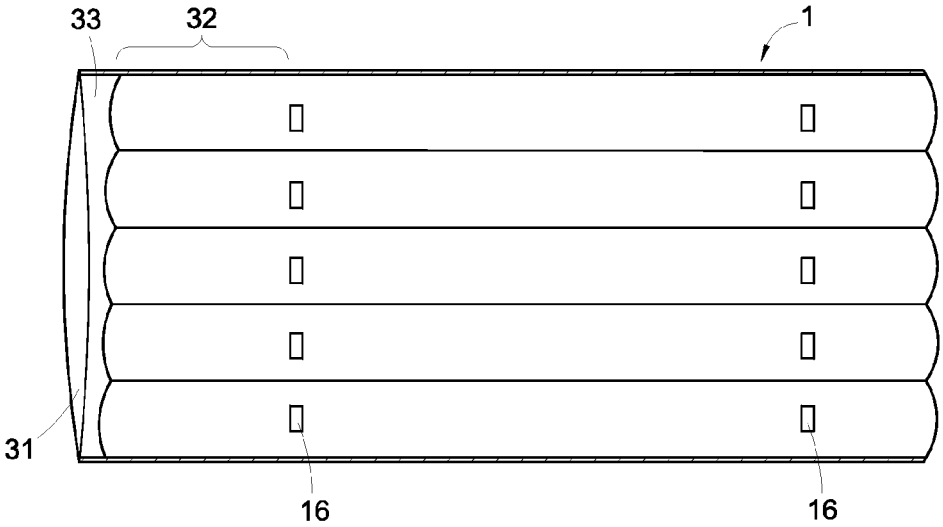
FIG. 5B is a backside view of the airbag that requires no sealing in accordance with the second preferred embodiment of the present invention.
Figure 5C:
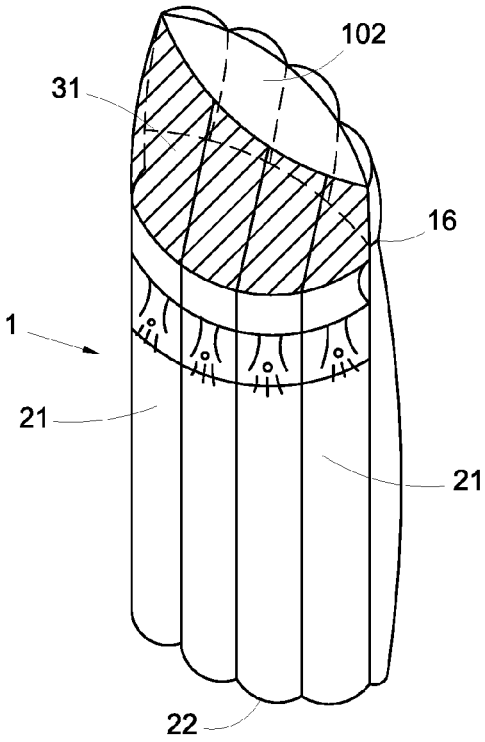
FIG. 5C is a schematic view of the inflated airbag that requires no sealing in accordance with the second preferred embodiment of the present invention.
Figure 6A:
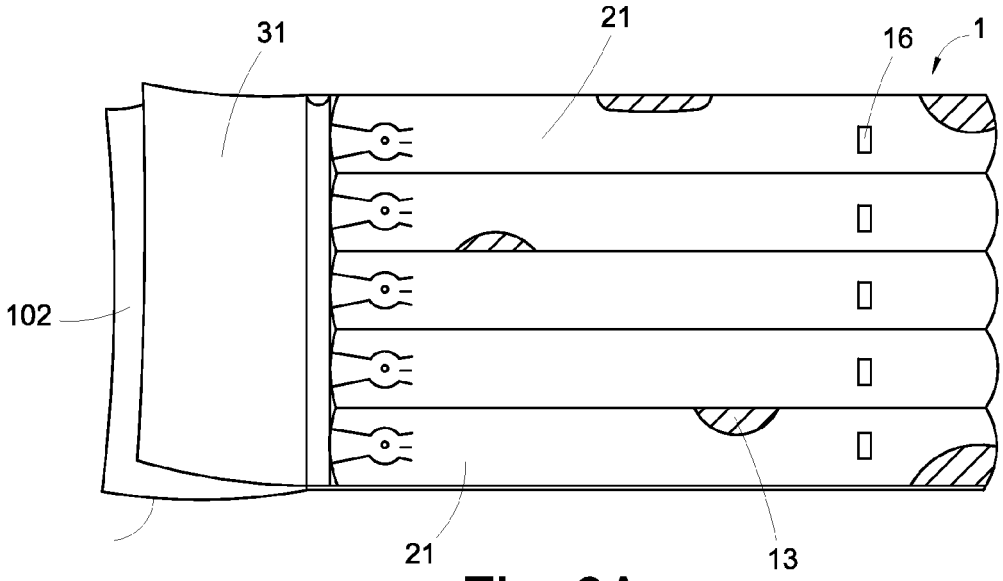
FIG. 6A is a planar view of the airbag that requires no sealing at a side of an extended section to form an open airbag in accordance with a third preferred embodiment of the present invention.
Figure 6B:
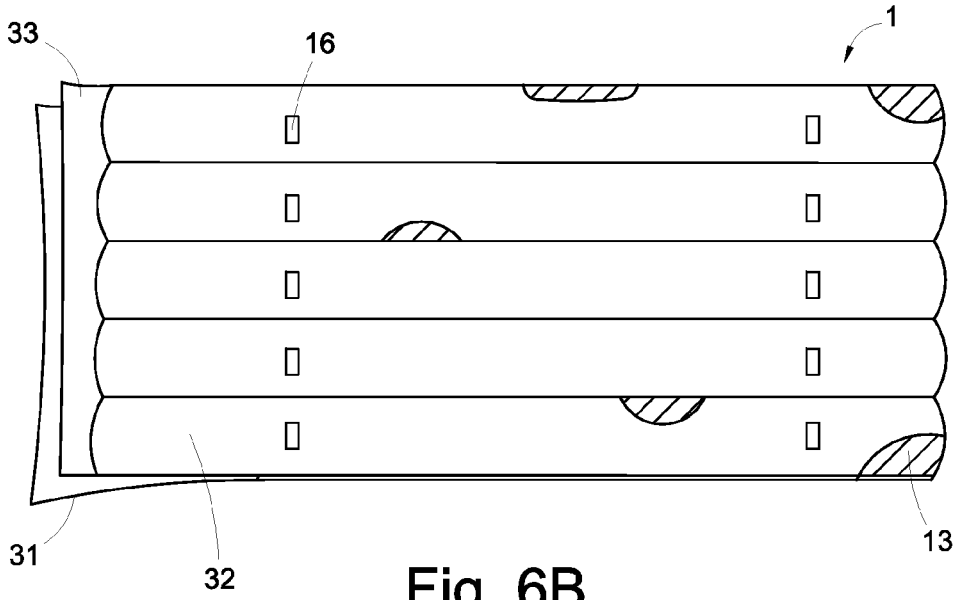
FIG. 6B is a rear view of the airbag that requires no sealing at a side of an extended section to form an open airbag in accordance with the third preferred embodiment of the present invention.
Figure 6C:
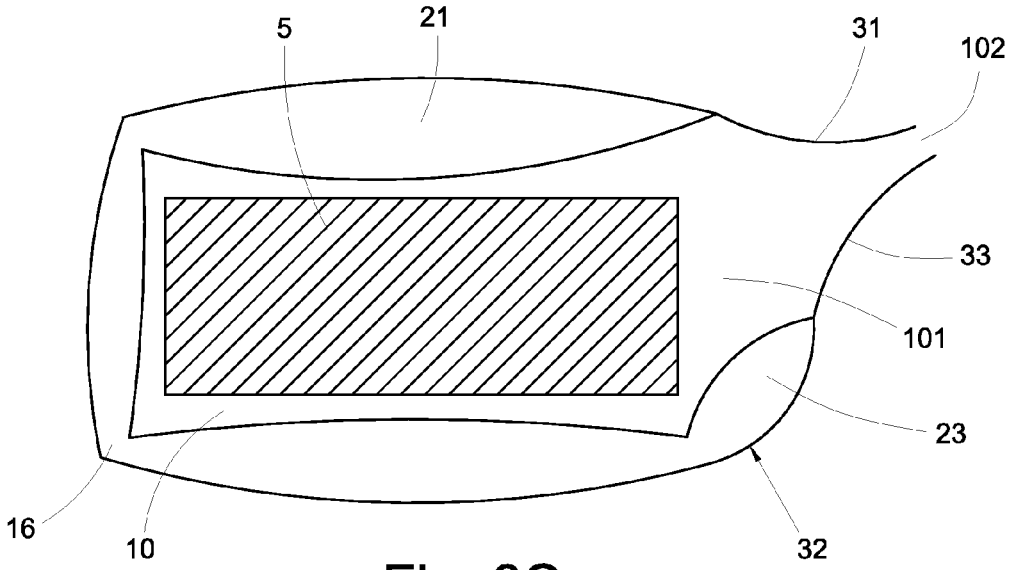
FIG. 6C is a schematic view of a first step of putting the airbag that requires no sealing at a side of an extended section in accordance with a third preferred embodiment of the present invention into a carton.
Figure 6D:
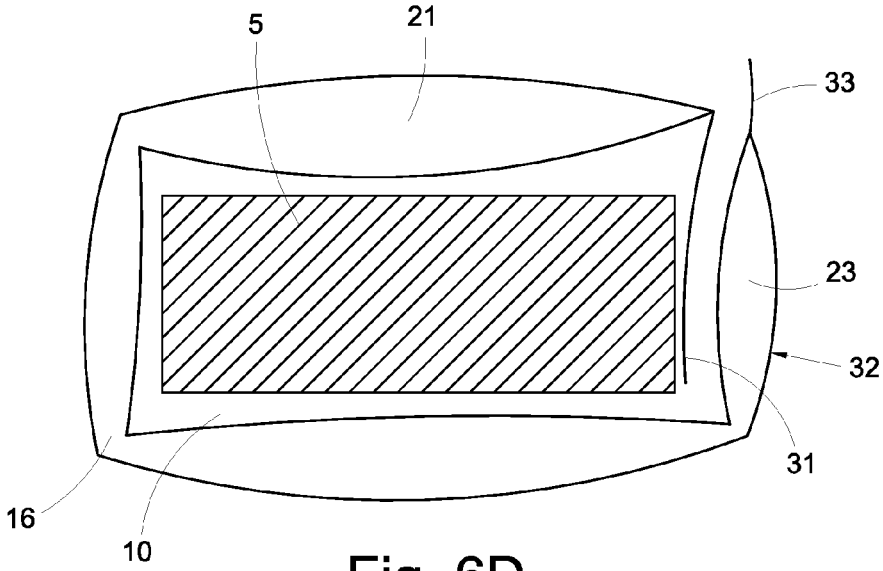
FIG. 6D is a schematic view of a second step of putting the airbag that requires no sealing at a side of an extended section in accordance with a third preferred embodiment of the present invention into a carton.
Figure 6E:
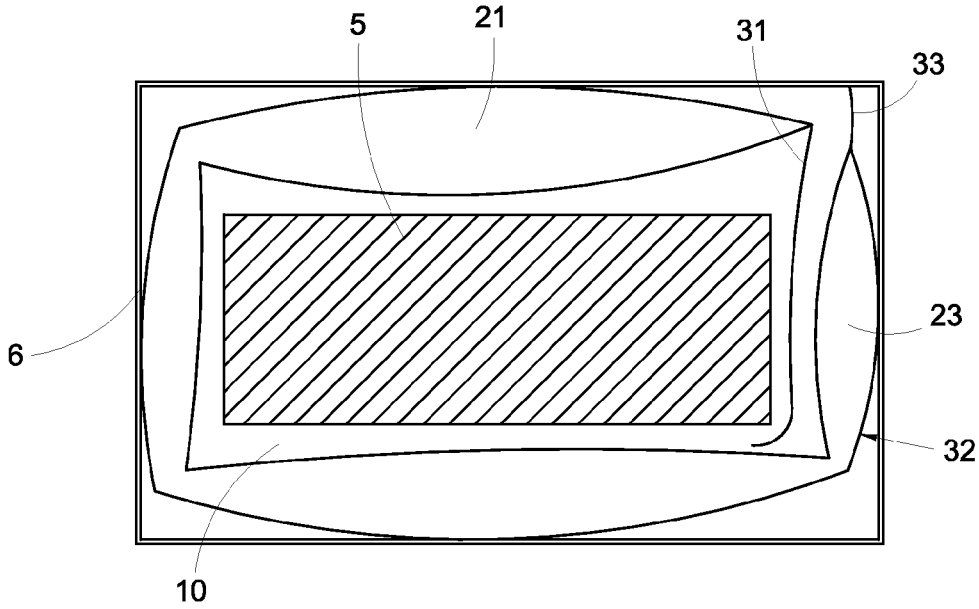
FIG. 6E is a schematic view of a third step of putting the airbag that requires no sealing at a side of an extended section in accordance with a third preferred embodiment of the present invention into a carton.

In the airbag of this preferred embodiment of the present invention, the airbag has a bag body formed by plastic inflatable air columns, characterized in that the air column bag includes a stop valve for stopping an inflation automatically, and two plastic films hot sealed into a plurality of buffer air columns to form an air column group, and the air column group includes a plurality of bendable nodes 16 disposed at the bottom of the air column group. The sides of the bag body 1 are connected and hot sealed to form a bag body 1 with a containing groove 10. The present invention discloses that the air columns are extended from each sides of the containing groove 10, and one side is reserved for the inflatable air columns 23, and the other side is for the non-inflated air column that forms a non-inflatable plastic extended-section plate 31, and a section is reserved at the rear end of each of the air columns 23 and the plate as a sealing material for forming a new disposing entrance 102 of the extended section. The node 16 of the inflatable air column group at the position of the bag mouth 101 of the containing groove 10 is hot sealed in advance, so that the inflatable extended-section air column 32 can be bent at the position of the bag mouth 101 of the containing groove 10 (as shown in FIG. 4A). In this preferred embodiment, an object to be packaged 5 at the position of the disposing entrance 102 of the extended section is placed, and the disposing entrance 102 of the extended section is sealed to form a hot sealing line 30 of the disposing entrance 102 (as shown in FIG. 4B), and then the bag body 1 is inflated and placed into a carton 6 (as shown in FIG. 4C), and the inflatable extended-section air column 32 is bent automatically towards the non-inflatable plastic extended-section plate 31 to form an air column 41 for buffering the heat portion of the object to be packaged 5. In other words, the present invention disposes an air column bag with a flat head portion capable for filling and sealing repeatedly.

Figure 2:
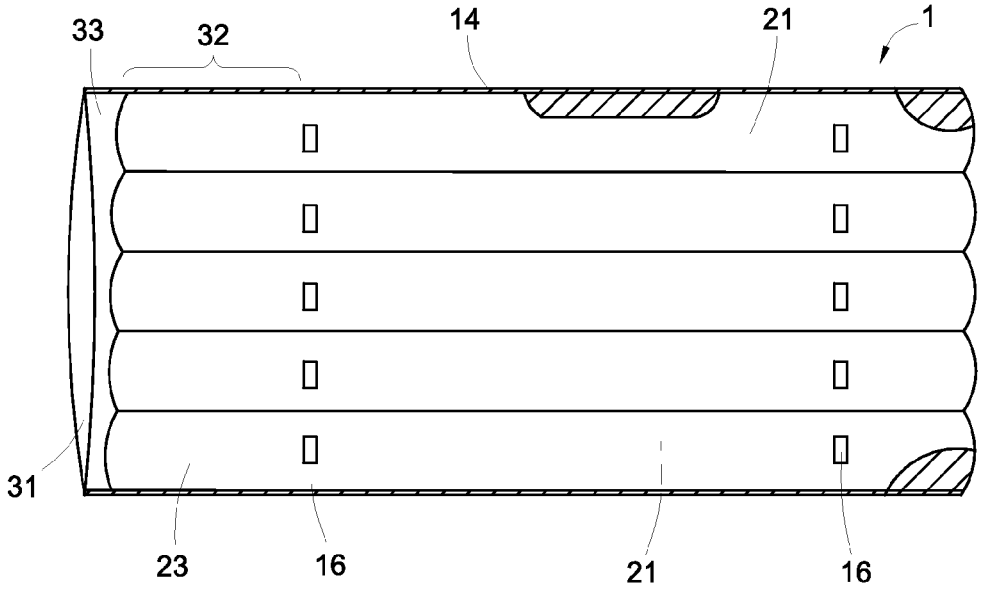
FIG. 2 is a backside view of the airbag in accordance with the first preferred embodiment of the present invention.
Figure 3:
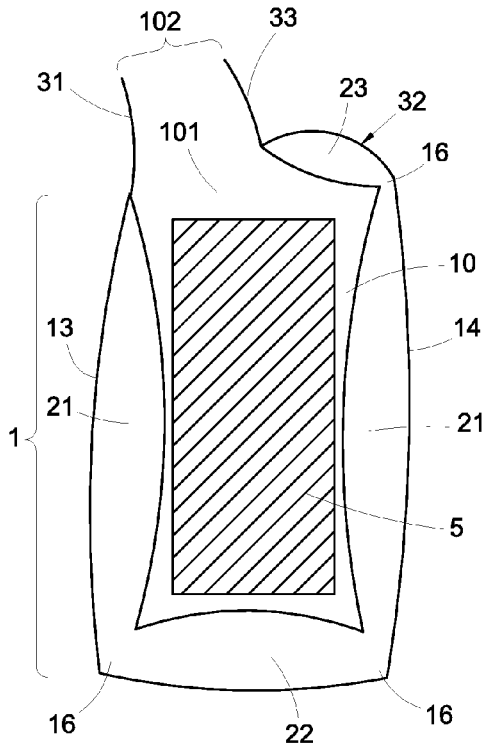
FIG. 3 is a cross-sectional view of inflating the airbag in accordance with a first preferred embodiment of the present invention.
Figure 3A:
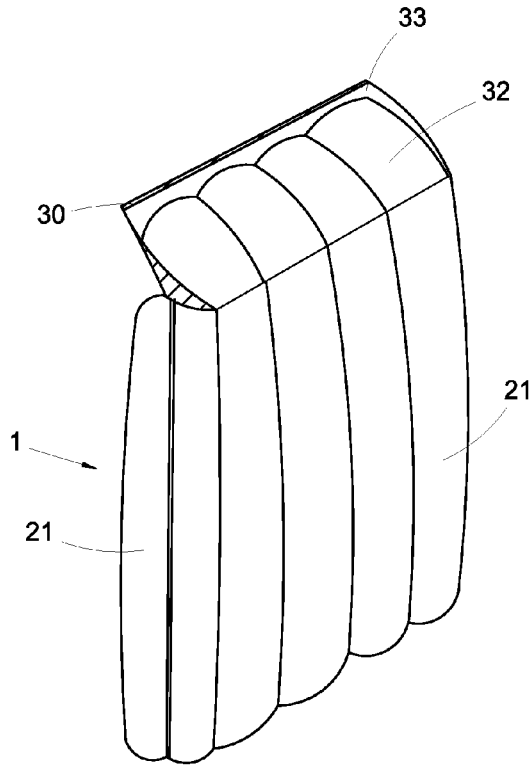
FIG. 3A is a perspective view of the air bag in accordance with the first preferred embodiment of the present invention the airbag.

With reference to FIGS. 1 to 4 for the first preferred embodiment of the present invention, FIG. 1 shows a front-side view, FIG. 2 shows a backside view, FIG. 3 shows a cross-sectional view of an inflated air column package bag, FIG. 3A shows a perspective view, and FIGS. 4A to 4C shows the steps of putting an inflated airbag into a carton 6 in accordance with the first preferred embodiment of the present invention.

In the aforementioned figures, the airbag with a bent head portion and a repeated sealing and filling effect of the present invention comprises a bag body 1, a containing groove 10 formed in the bag body 1, and a bag mouth 101 formed at the top side of the bag body 1 and interconnected to the containing groove 10, and the bag body 1 being formed by a plurality of first air columns 21 and second air columns 22 for providing a buffering function, wherein the first air column 21 and the second air column 22 of the bag body can be made of a transparent or opaque plastic film. If the opaque plastic material is adopted, the external light passing from the bag mouth 101 and the bag body 1 into the containing groove 10 can be blocked.

The extended section is composed of a non-inflatable plastic extended-section plate 31 extended from a side above the opening 101 and an inflatable plastic extended-section air column 32 extended from the first air column 21 on the other side to form the top at the first bag face 13 and the second bag face 14, and a new disposing entrance 102 is formed at the rear of the extended section, and a node 16 is formed between the first air column 21 and the extended-section air column 32. The extended-section air column 32 can be bent to a side of the extended-section plate 31 when passing through the node 16, so that the extended-section plate 31 and the extended-section air column 32 can be stacked with one another, and a non-inflatable protruding plate 33 is formed at the edge of the extended-section air column 32 to become a reserved end material. In other words, an extra non-inflatable material is reserved at the rear end of the disposing entrance 102 of the extended section. After the rear end is hot sealed, the sealing can be cut open, and a rework is required for the next use. Therefore, the position of the disposing entrance 102 at the extended-section plate 31 and the protruding plate 33 can be sealed, cut, opened, and sealed repeatedly without damaging the original air column bag functions. In addition, the extended-section plate 31 and the extended-section air column 32 are plastic plates formed by extending an external film or an internal film of the bag body 1, or closing the internal and external films into the air inlet to form the non-inflatable plastic plate.

In a second preferred embodiment, a package with a flat head portion is provided for packaging an object to be packaged 5 that does not require any sealing.

With reference to FIGS. 5A to 5C and 6A to 6E, the present invention provides another package for packaging an object to be packaged that does not require any sealing. In the airbag of the first preferred embodiment of the present invention, the airbag can be extended and the object to be packaged 5 can be placed into the airbag from the disposing entrance 102 without sealing the airbag. In other words, the disposing entrance 102 is open, and then air is inflated, so that the air columns 21, 22, 23 of the bag body 1 are filled with air to bend the inflated air column 32 of the extended section towards the non-inflatable extended-section plate 31 to form an air column group for protecting the flat head portion of the object to be packaged 5. Since the extended-section plate 31 is a soft plastic plate, therefore when the extended-section air column 32 is bent, the extended-section air column 32 is bent into an area of the head portion of the object to be packaged 5, and then the extended-section air column 32 will be covered onto that area, and the airbag is put into the carton 6. The air column bag is bent to form a buffer bag with a flat head portion. This preferred embodiment shows how to place an inflated airbag into the carton 6 without sealing the disposing entrance and how to naturally bend to form a buffer structure with a flat head portion.

In the third preferred embodiment, the extended-section plate is disposed adjacent to the inflatable extended-section air column but not connected to the inflatable extended-section air column.

With reference to FIGS. 5A to 5C and FIGS. 6A to 6E for another application of the present invention, this preferred embodiment includes a bag body 1 having a non-inflatable extended-section plate 31 and an inflatable extended-section air column 32, and a new disposing entrance 102 is formed and extended above the bag mouth 101. The present invention specially discloses the extended section formed at the position of the bag mouth 101 of the bag body 1 and extended from the extended-section plate 31, and the inflatable extended-section air column 32, and the inflatable extended-section air column 32 still includes a node 16 for bending, and the adjacent sides of the extended sections are not connected with one another, so that independent extended-section plate 31 and extended-section air column 32 can be formed. When the airbag is applied for an object to be packaged 5 with an irregular head portion and requiring no sealing, then the extended-section plate 31 can serve as a first cover plate of the object to be packaged 5 and then the inflated extended-section air column 32 is covered thereon. If the plastic extended-section plate 31 has a sufficient length, the extended-section plate 31 is folded into two layers and stacked to further protect the group of the head portion air columns 23 from being pierced or damaged by the rough surface of the object to be packaged 5.

Therefore, the extended-section plate 31 can have a length equal to or unequal to the length of the extended-section air column 32. If the extended-section plate 31 has a length greater than the length of the extended-section air column 32, the extra portion forms a folding block (or a cover plate) together with the object to be packaged 5 to be placed into the containing groove 10 to form a disposing entrance 102 without sealing and provide a natural cover plate for shadowing the light.

Figure 7:
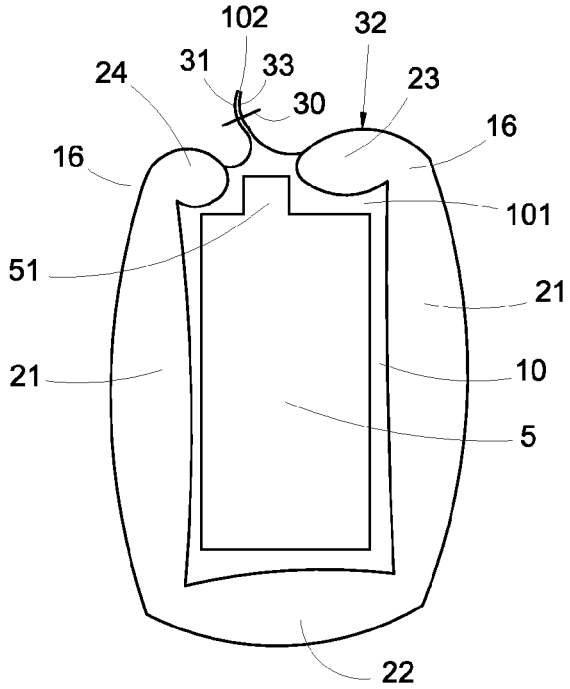
FIG. 7 is a schematic view of a first kind of package used for packaging an object to be packaged with a bump-like head portion into the airbag in accordance with a fourth preferred embodiment of the present invention.
Figure 7A:
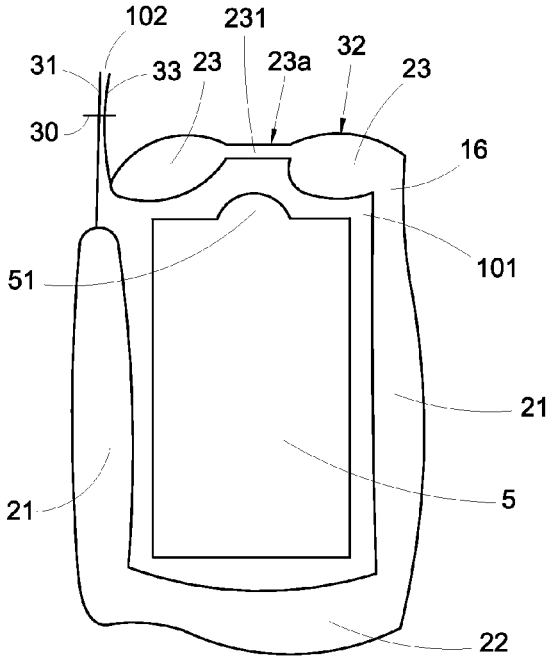
FIG. 7A is a schematic view of a second kind of package used for packaging an object to be packaged with a bump-like head portion into the airbag in accordance with the fourth preferred embodiment of the present invention.
Figure 8:
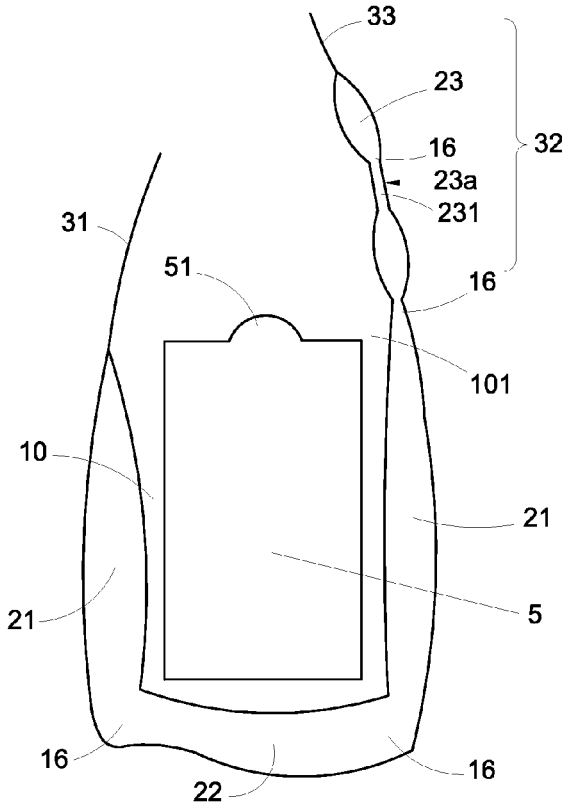
FIG. 8 is a schematic view of a package for packing an irregular head portion into the airbag in accordance with the fourth preferred embodiment of the present invention.

With reference to FIGS. 7, 7A and 8 for a fourth preferred embodiment for packing an non-flat head portion, this embodiment of the present invention further provides a way of packing a non-flat head portion. There are three solutions. Firstly, a protrusion 51 of the object to be packaged 5 is defined as a boundary and the inflatable extended-section air column 32 is extended from the node 16 of the containing groove 10 to a position adjacent to the protrusion 51. The original non-inflatable extended-section plate 31 is extended from the node 16 to the protrusion 51 of the object to be packaged 5 according to the reserved form of the air column 24, and then the air column 24 are closed to form the non-inflatable extended-section plate 31, and the inflatable air column 24 is closed at a position adjacent to a side of the non-inflatable plastic plate instead. The disposing entrance is sealed by hot sealing the position at the non-inflatable extended-section plate 31 and the extended-section air column 32, not only preventing the protrusion 51 from piercing and breaking the air columns 23, 24, but also achieve the effects of resisting moisture, maintaining a flat head portion of the air column and saving storage space after the airbag is sealed.

Secondly, a packaging method for a non-flat head portion is provided. The air column 23 situated in a flat area of the head portion of the object to be packaged is enlarged, and the air column situated at the protruding position of the non-flat head portion is reduced. In FIG. 8, the area of the extended-section air column 32 situated in a flat area is increased to a level higher than the non-flat area, and the whole or a part of the air column 231 situated in a non-flat area is closed to form a reduced section 23*a* so as to reduce the area or a portion of the non-inflatable plastic plate. Such arrangement can prevent the protrusion 51 in the non-flat area from piercing, so as to provide an effective buffering and protection effect of the head portion.

Thirdly, a way of packing a non-flat surface of the head portion is provided. If the head portion of the object to be packaged is protruded and has an irregular shape, the extended-section air column 32 of the first air column 21 situated at the air column 231 above the protrusion 51 can be closed partially, or the air column 231 can be reduced to form a reduced section 23*a*, so as to avoid the protrusion 51. After leaving the protrusion 51, the air column 23 is enlarged, and the area is recovered, and then the non-inflatable extended-section plate 31 and the extended-section air column 32 can provide a flat air column 23. Such arrangement can provide an effective buffering effect without being pierced or damaged easily by sharp objects.

Figure 9A:
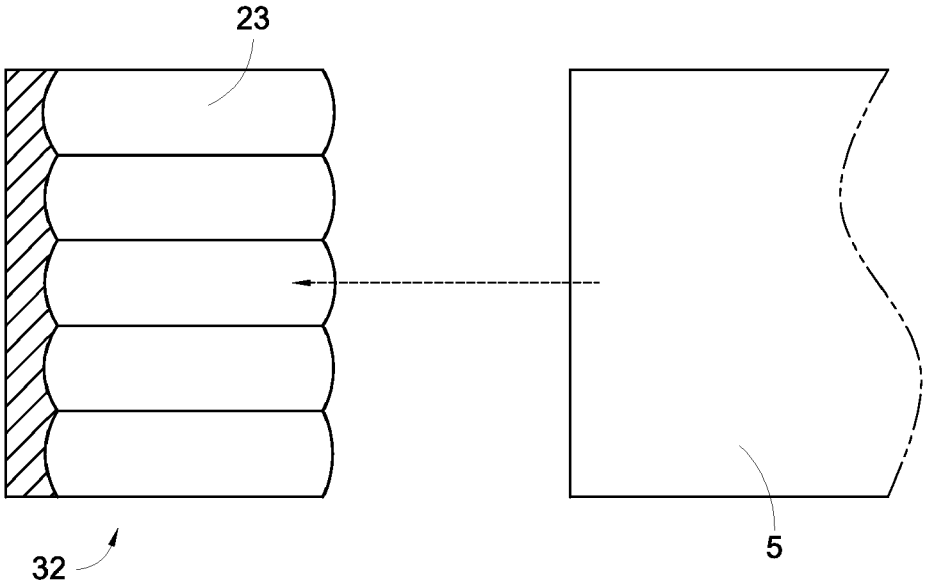
FIGS. 9A to 9C are schematic views of packaging a cylindrical head portion, showing the change of the air column at the head portion, and the inflated area of the air column into the airbag in accordance with the fourth preferred embodiment of the present invention.
Figure 9B:
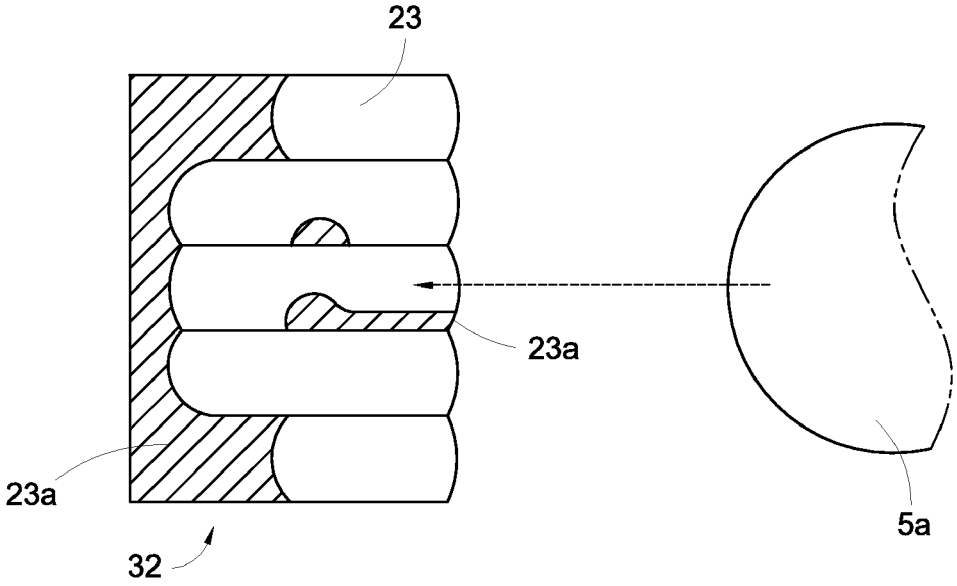
Figure 9C:
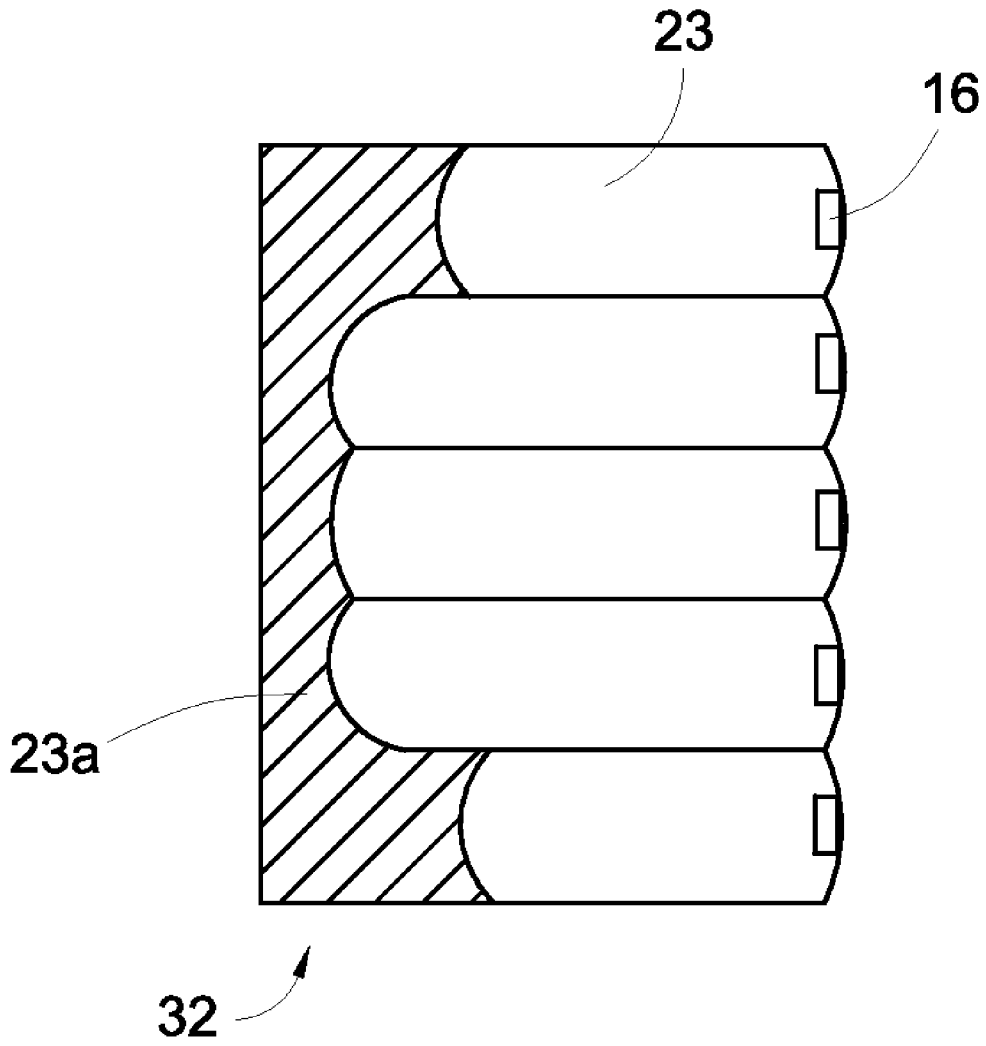

With reference to FIGS. 9A to 9C for schematic views of a cylindrical head portion of the airbag, the change of the head portion air columns, and the inflated area of the air column in accordance with the fifth preferred embodiment of the present invention respectively, the present invention further discloses that when the object to be packaged 5*a* is a cylindrical body, the area of the air column 23 of the inflatable extended-section air column 32 can be reduced according to the semi-circular shape, so that when the group of the air columns 23 can be inflated to cover onto the head portion of the object to be packaged 5*a*, a substantially semicircular shape can be formed to fit the shape of the object to be packaged 5*a*.

In the airbags according to the first to fifth preferred embodiments of the present invention, the node 16 can be in a square, circular-dot, elliptical or arch shape.

In addition, the inflated shape, length, inflated area of the extended-section air column 32 of the airbag and the length of the protruding plate 33 correspond to the roughness of the head portion of the objects to be packaged 5, 5*a* and can be changed according to the shape of the object to be packaged 5, 5*a*, but not limited to those described in the embodiments of the present invention only.

In the airbag of the preferred embodiments of the present invention, the extended section includes a plurality of inflatable air column 23, and the node 16 is hot sealed at the position of the bag mouth 101 of the original containing groove 10, so that after the air columns 23 are inflated, a bend is formed naturally at the position of the node 16 to cover the of the bag mouth 101 containing groove 10. The present invention further discloses the non-inflatable plastic plate of the extended section together with the plurality of inflatable air columns 23 to form a new disposing entrance 102. After the object to be packaged 5, 5*a* is placed, the disposing entrance 102 can be sealed by a hot sealing process and air is inflated, so that the inflatable air column 23 and the air columns 21, 22 of the bag body 1 expand, so that a side of the soft non-inflatable plastic plate is soft, and the inflated air column 23 on the other the other side has a bendable node 16. Therefore, the inflated air column 23 can be bent towards the plastic extended-section plate 31 to form a head portion having a flat right-angle buffer body.

The airbag of the present invention has the function of sealing the plastic film, and also adopts an opaque plastic material for making the airbag to enhance the effect of resisting light without adding a black bag. The airbag of the invention will not form a sharp corner of the head portion after the airbag is inflated and sealed or require a large carton. The present invention further uses an edge strip of the extended section as a sealing area, so that if it is necessary to rework or remove the object to be packaged, the edge strip can be cut open successfully. After the rework is completed, and another object to be packaged is placed and the airbag is sealed again without affecting the buffering function of the air column, and the present invention provide repeated opening and sealing functions and the "head portion forms no sharp corner after the sealing takes place, and the head portion of the carton is closed automatically and the effects of "resisting moisture and light" can be achieved to save materials and efforts and comply with the current trends of environmental protection and reducing wastes.

What is claimed is:

1. An airbag with a bent head portion and a repeated sealing and filling effect, comprising:

a bag body, formed by a plurality of buffer air columns, and having a plurality of heat-sealing nodes formed on the air column, and the air column being bent when passing through the node, and the bag body having a containing groove formed therein, and bag mouth formed on the bag body and interconnected to the containing groove;

a plurality of inflatable extended-section air columns, arranged on a side of the external periphery of the bag mouth, and having a non-inflatable protruding plate formed at an edge of the extended-section air column; and an extended-section plate, disposed on the other side of the external periphery of the bag mouth, and a disposing entrance being formed between the extended-section plate and the protruding plate for a repeated seal.

2. The airbag with a bent head portion and a repeated sealing and filling effect as recited in claim 1, wherein the air column is interconnected to the extended-section air column, and the node is formed between the spacer column and the extended-section air column, and the air column is inflated, and the extended-section air column is bent towards a side of the extended-section plate a side when passing the node to form a flat buffer air column surface for covering the object to be packaged.

3. The airbag with a bent head portion and a repeated sealing and filling effect as recited in claim 1, wherein the containing groove includes an object to be packaged placed therein, and the air column is inflated, and the disposing entrance is maintained at an open state, and the extended-section plate and the extended-section air column are stacked to form a flat buffer structure at the top of the object to be packaged.

4. The airbag with a bent head portion and a repeated sealing and filling effect as recited in claim 1, wherein the containing groove includes an object to be packaged placed therein, and the air column is inflated, and the disposing entrance is maintained at an open state, and the extended-section plate is bent towards a side of the extended-section air column, and the extended-section air column is bent towards a side of the extended-section plate, and the extended-section plate is disposed on an internal side of the extended-section air column to form a stop plate to prevent the head portion of the object to be packaged from piercing and breaking the extended-section air column.

5. The airbag with a bent head portion and a repeated sealing and filling effect as recited in claim 1, wherein an external film or a plate for composing the bag body and the extended-section air column is made of an opaque plastic material for shadowing an external light projecting through the bag mouth into the containing groove.

6. The airbag with a bent head portion and a repeated sealing and filling effect as recited in claim 3, wherein the extended-section plate has a length equal to or unequal to the length of the extended-section air column, and if the length of the extended-section plate is greater than the length of the extended-section air column, an extra portion forms a folding block placed together with the object to be packaged into the containing groove to a natural cover plate capable of shadowing the light without sealing the disposing entrance.

7. The airbag with a bent head portion and a repeated sealing and filling effect as recited in claim 1, wherein each of the adjacent extended-section air columns in a connecting area with the extended-section plate is hot sealed to reduce the extended-section air column in compliance with the bag mouth.

8. The airbag with a bent head portion and a repeated sealing and filling effect as recited in claim 1, wherein the node is in a square, circular-dot, elliptical or arch shape.

9. The airbag with a bent head portion and a repeated sealing and filling effect as recited in claim 2, wherein the node is in a square, circular-dot, elliptical or arch shape.

10. The airbag with a bent head portion and a repeated sealing and filling effect as recited in claim 1, wherein the extended-section air column is inflated into a shape, a length, and an area according to the length of the protruding plate and the condition of a bump-like head position of an object to be packaged.

11. The airbag with a bent head portion and a repeated sealing and filling effect as recited in claim 1, wherein the protruding plate and extended-section plate are cut open at the position of the disposing entrance, and sealed again for a plurality of times.

* * * * *